United States Patent [19]

Krueger

[11] Patent Number: 5,047,109

[45] **Date of Patent: * Sep. 10, 1991**

[54] APPARATUS FOR PRODUCTION OF BIAS FABRICS

[75] Inventor: Ronald G. Krueger, Sparks, Nev.

[73] Assignee: JB Group, Inc., Greenwich, Conn.

[ * ] Notice: The portion of the term of this patent subsequent to Dec. 3, 2002 has been disclaimed.

[21] Appl. No.: 427,445

[22] Filed: Oct. 26, 1989

Related U.S. Application Data

[62] Division of Ser. No. 922,344, Oct. 23, 1986, Pat. No. 4,877,470.

[51] Int. Cl.[5] ..... D04B 23/00; D04H 3/00

[52] U.S. Cl. ..... 156/440; 156/441; 156/439; 156/177; 156/181; 66/84 A; 66/84 R; 28/100; 28/102

[58] Field of Search ..... 156/177, 181, 439, 440, 156/441; 28/100, 102; 66/84 R, 84 A, 85

[56] References Cited

U.S. PATENT DOCUMENTS

| | | | |
|---|---|---|---|
| 3,564,872 | 2/1971 | Klaeui | 28/100 X |
| 3,756,043 | 9/1973 | Kemter | 66/84 A |
| 4,556,440 | 12/1985 | Krueger | 156/181 |
| 4,677,831 | 7/1987 | Wunner | 66/84 A |
| 4,841,747 | 6/1989 | Frenzel et al. | 66/84 A |

*Primary Examiner*—Michael W. Ball

*Assistant Examiner*—Jeff H. Aftergut

*Attorney, Agent, or Firm*—Darby & Darby

[57] ABSTRACT

Non-woven, bias laid fabrics, where the various fabric layers are held together by external means, such as stitching, and wherein, preferably, at least two of the layers are formed at an angle of from 30° to 150° relative to the long axis of the fabric, are formed by directing at least two pluralities of yarns back and forth across the width of the forming fabric, to be wrapped around or mounted on a series of needles formed on a moving conveyor, one conveyor being placed on either side and moving in the direction of the long axis of the fabric. Speed of movement of the yarns can be determined by the speed of movement of the mechanism for the machine operated to hold the various fabric layers together; preferably said machine mechanism moves more slowly near the ends of each cycle, so that yarn carriers are similarly slowed at either end of the forming fabric width, aiding in making successive courses of yarn lie parallel to each other without the necessity for extra equipment. A second series of needles is provided beyond each moving conveyor, in association with each plurality of yarns being directed back and forth across the width of the forming fabric, to accept the plurality of yarns and place them onto or into the needles on the moving conveyor, the additional series of needles providing for parallelism in each plurality of yarns, with or without overlap of each plurality of yarns.

11 Claims, 2 Drawing Sheets

FIG. 1
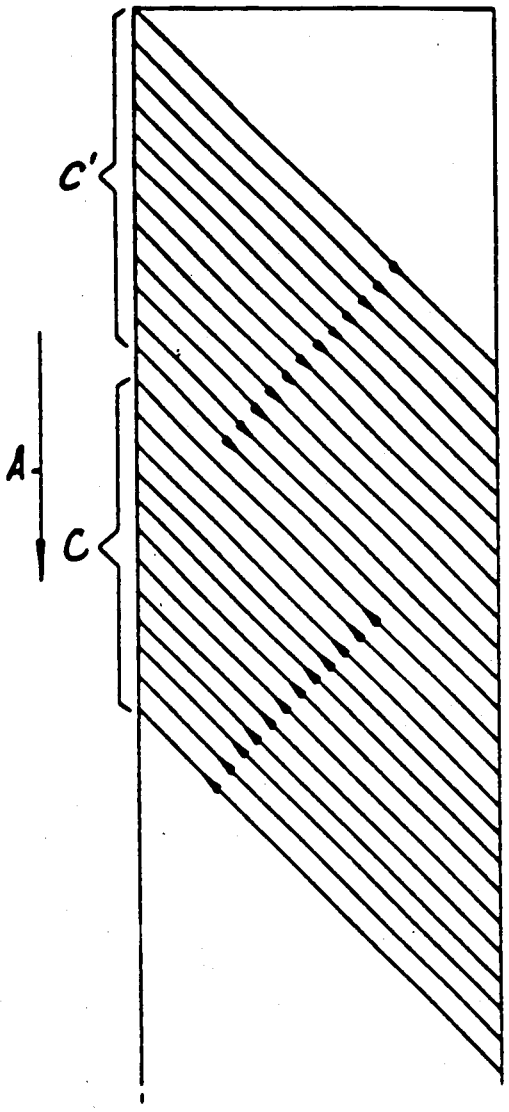
FIG. 2
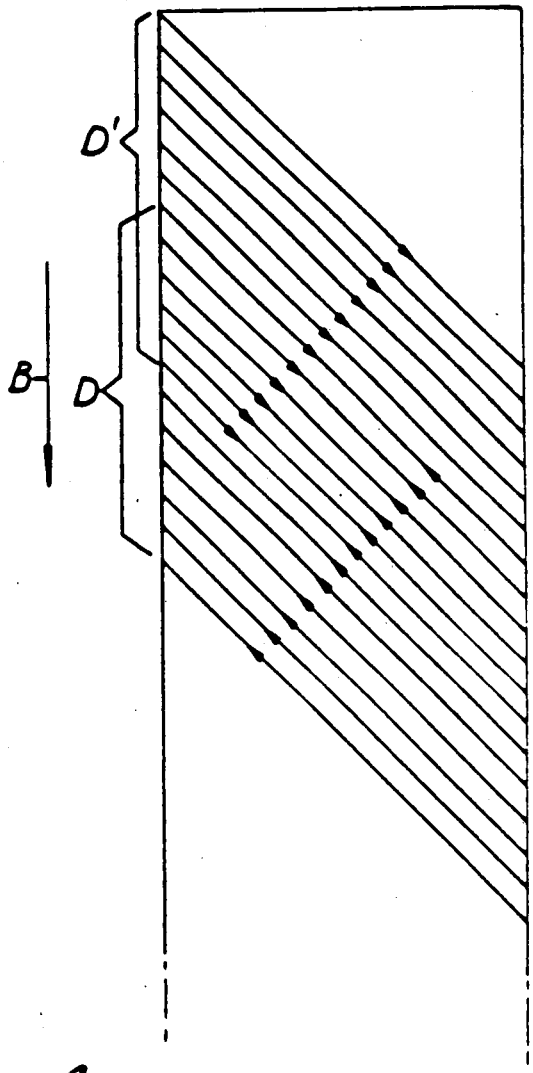
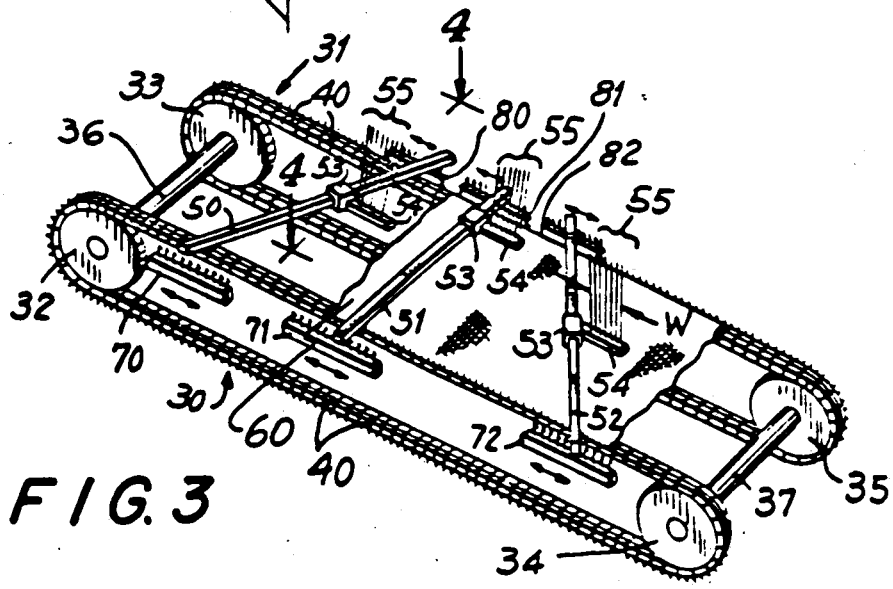
FIG. 3

FIG. 4
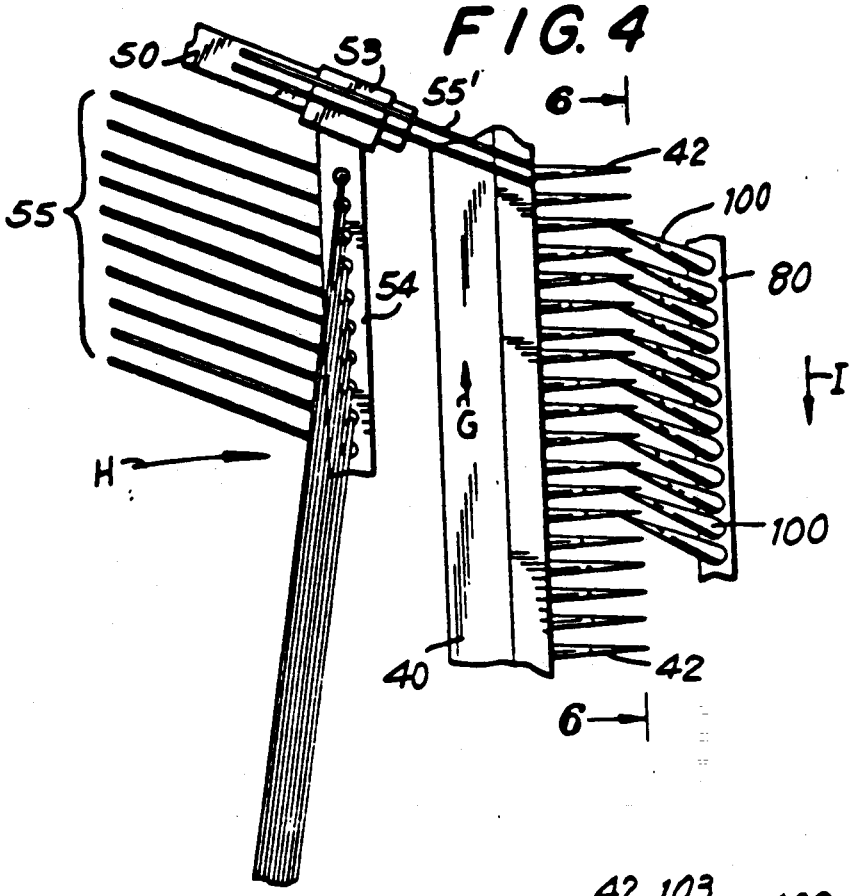
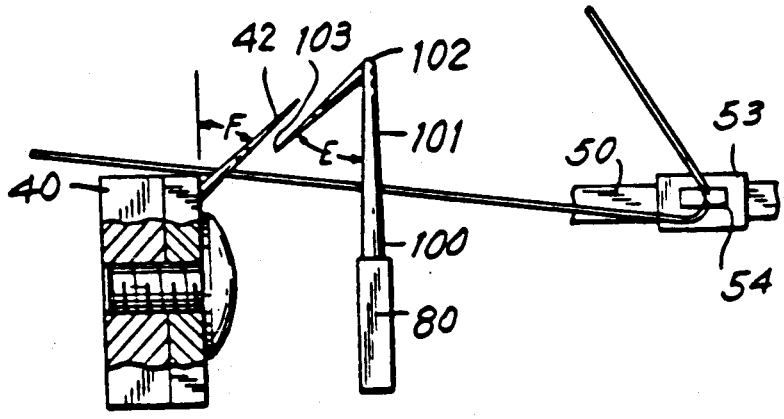
FIG. 5
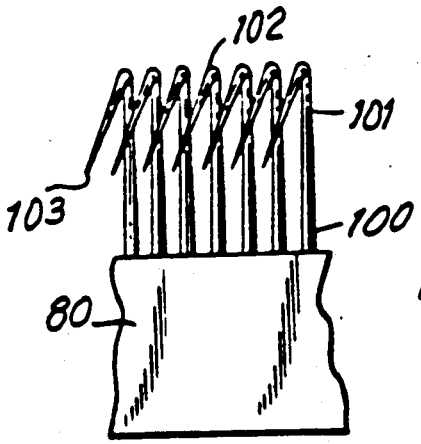
FIG. 6

APPARATUS FOR PRODUCTION OF BIAS FABRICS

This is a division of application Ser. No. 922,344, filed Oct. 23, 1986 now U.S. Pat. No. 4,877,470.

FIELD OF THE INVENTION

The present invention is directed to method and apparatus for forming bias laid, non-woven fabrics wherein, preferably, the yarns in at least two of the layers of fabric are laid at an angle of from 30° to 150° to the long axis of the fabric. In such fabrics, the yarns in the various layers are neither knitted, nor woven, but are held together by stitching through the layers, or by other external means, such as adhesive bonding.

THE PRIOR ART

The history of fabric formation is a long one. Most fabrics are made by the now traditional processes of knitting, weaving, etc., and sophisticated machinery has been developed for automatically manufacturing fabrics in accordance with these techniques.

For many modern usages, particularly in areas where structural strength and integrity are required, fabrics manufactured by the older techniques cannot be used. Such uses include structural parts for high speed airplanes where the fabric is to be impregnated with a curable resin system.

In the modern usages referred to, the traditional knitted or woven fabrics do not provide sufficient strength, even when impregnated with a curable resin system, following cure, to provide the necessary uniformity and strength. Accordingly, non-woven fabrics have been developed for such utilization.

The non-woven fabrics which have been developed for these structural uses involve a series of layers which are laid down, generally in a continuously formed fabric, and with at least the final width of the fabric during formation, the layers ultimately being held together by stitching through the layers, knitting with a loose stitch through the layers, or adhesively bonding threads of the layers at crossing points. The composition of the stitching material or of the adhesive material is not of critical importance, so long as the material has sufficient strength to hold the various layers together up to the time of resin impregnation, since the final strength of the part formed and the holding of the various yarns of the fabric in their proper position is accomplished by the cured resin.

The most desirable of the non-woven fabrics for structural purposes has been found to be those with at least two layers, the yarns of which are at an angle of approximately 45° to the long axis of the fabric direction, the two layers lying at 90° to each other. There can be more than two layers of yarns, depending upon the end use to which the fabric is to be put and either the first two layers, or any successive layers, can be placed at angles varying from 30° to 150° to the long axis of the fabric. If desired, a series of warp threads, lying parallel to the long axis of the fabric, a series of weft threads, lying at approximately 90° to the long axis of the fabric, or both, can be included. Once all of the fabric layers have been placed, the fabric is held together for storage, shipment, and ultimate impregnation, by one of the referenced methods, i.e., stitching, loose weave knitting, or adhesive bonding.

Among patents showing the formation of similar types of fabric are Eaton, U.S. Pat. No. 3,607,565; Smith, U.S. Pat. No. 3,765,893; and Campman et al U.S. Pat. No. 4,325,999.

The Campman et al patent particularly describes a number of methods for forming bias laid, non-woven fabrics, as generally referred to in the present patent application. However, as will be observed from a review of Campman et al, successive courses of each set of yarns there are laid in a pattern such that each course is angled at 90° to the previous course. For purposes of this invention, a course is defined as the plurality of yarns laid together in traversing the distance from one side of the fabric being formed to the opposite side; when the plurality of yarns reverses directions, and returns from the second side to the first side, that is a second course.

In Campman et al, prior to the reversal of direction of the yarns, so as to lay a second course, the yarns are wrapped around a series of pins, the number of pins corresponding to the number of yarns being laid. When the plurality of yarns is returned to the first side of the forming fabric, the yarns are wrapped about a set of pins formed on the conveyor on the first side, and, again, direction reversed by 90° so as to be returned to the second side for a fourth course. Campman et al do show one embodiment in which the courses of yarns formed by a single set of moving yarns are parallel to each other. That is, essentially, shown in FIG. 10 of the Campman et al patent, and the portion of the disclosure relating to that figure. However, a relatively complex mechanism is necessary to accomplish this parallelism between courses, the complex mechanism including two sets of pins on each side of the fabric being formed to allow the second, or return course, to be parallel to the first. None of the other automatic types of bias fabric formation machinery known to applicant provides even a mechanism of this complexity for forming parallel courses, except for applicant's patent, referred to below.

The inability to provide parallel courses results, in many instances, in a diminution of strength of the structural member being formed from these bias laid, non-woven fabrics. Further, because there is a waste of yarn due to the 90° return angle, which causes the second course to partially overlie the first course, the expense of the bias laid, non-woven fabric is greater than it would be if parallel courses were possible.

In my prior U.S. Pat. No. 4,556,440, a method and apparatus are shown for forming bias laid, non-woven fabrics, in parallel based, in part, on the speed of the yarn carrying means being diminished near the ends of its travel and possible movement of those means in a direction opposite the direction of fabric travel at a point where the yarns being conveyed are to be placed onto or between the needles of the continous conveyors. That patent also describes the possibility of some overlap of a returning course over a course already laid from the same group of yarns. However, as that patent stated, when such an overlap is created, there is also a slight angle between the course first laid and the return course.

In Klaeui, U.S. Pat. No. 3,564,872, an apparatus and process for laying parallel courses of yarn is also taught, employing a rake. However, the disclosure of the Klaeui patent is limited to yarns laid at a 90° angle to the direction of movement of the conveyors; there is no provision for an overlapping of a return course, the courses in Klaeui being laid adjacent each other; and all of the operating systems, including the conveyors, the yarn carriers, and the rakes, are driven from the same system of gears and pulleys, so that no variation is possible between the various operating systems, once a machine is constructed.

Further, Klaeui does not teach the possibility of impaling the yarns on either the rake or on the means formed on the conveyors for holding the yarns.

The prior art has not shown a process or apparatus which allows fully parallel courses of bias laid, nonwoven fabrics to be placed on moving conveyors where partial overlapping of return courses is provided for and where the yarns being laid onto the conveyor can be either placed between holding means, such as needles, or impaled on them. Because of the greater control of strength and uniformity provided by either or both of these steps, such apparatus and process have been ardently sought.

BRIEF DESCRIPTION OF THE INVENTION

In accordance with the present invention, it has unexpectedly been discovered that if a rake mechanism, synchronized with, but driven separately from, the conveyors, yarn carrying means, and bonding mechanism, is associated with the needles formed on the conveyors, greater assurance of parallelism of the yarns is achieved. Further, employing this rake mechanism, successive courses of yarn can overlie a portion of an already laid course so as to better control the strength and thickness of the resulting layer, the overlying portions being parallel to the first courses. As with the invention set forth in my prior patent, it is not important whether the individual yarns fall between the needles or are impaled on the needles, and that is true with regard to both the needles of the conveyor and the needles of the rake system.

Preferably, the needles on the rake system are formed at an angle to correspond to and supplement the angle of the approaching yarns being fed by the yarn carrying means, at each end of the travel limits of the yarn carrying means. Thus, for example, if the yarn carrying means is angled at 45° to the angle of travel of the fabric being formed, then the needles of the rake mechanism beyond one of the conveyors is formed at 45° and the needles of the rake mechanism beyond the opposite conveyor are formed at 135°. Similarly, when the yarn carrying means is at an angle of 30°, then the needles of the rake mechanism beyond the first conveyor are at an angle of 30°, while the needles on the rake mechanism beyond the opposite conveyor are at an angle of 150°. The rakes, themselves, to which the needles are attached, are always parallel to the belt conveyor system.

The purpose of the rake mechanism is to accept and retain the yarns being carried by the yarn carrying means at either end of the extremities of travel of the yarn carrying means. Thus, the yarns being carried by the yarn carrying means are accepted between the needles of the rake mechanism on the appropriate side of the fabric forming apparatus, either by being placed between adjacent needles, or by being impaled by one of the needles. The rake mechanism, through a movement opposed to the direction of travel of the conveyors on the fabric forming mechanism, and in conjuction with the return travel of the yarn carrying means, places the yarns onto or between the appropriate needles on the conveyors of the fabric forming mechanism. Again, the yarns can be placed between adjacent needles on the conveyors, or can be impaled on those needles. As explained in my prior patent, the impaling of yarns on the needles frequently provides for a more uniform product.

In order to make certain that the yarns are appropriately held within or on the needles of the rake mechanism, when the yarn carrying means is travelling in, essentially, the same direction as the fabric forming mechanism, the rakes must first be moved a slight distance in the same direction as the conveyors, whereby the yarns are trapped by the rake mechanism, and then the rake mechanism will move backward, against the direction of travel of the conveyor, in order to release the yarns to the conveyor needles. When the direction of travel of the yarn carrying means is, essentially, against the direction of travel of the fabric forming mechanism, this double motion of the rake mechanism is not required, and the rake mechanism need merely move opposite the direction of travel of the fabric forming mechanism. When the rakes are moved a slight distance in the same direction as the conveyors, the movement is sufficient to place the yarns over the needles of the rake, generally a movement of at least one needle space, and preferably two or three needles spaces. The amount of movement of the rake in this additional direction does tend to vary with the thickness of the yarn being employed.

Two different modes of operation are possible for the rake mechanism. In its travel opposite the direction of movement of the fabric forming mechanism, the rake system may either move a distance which is the same as the width of the yarns being carried by the yarn carrying means, i.e., a full course, or may move a distance equivalent to only a portion of the width of the yarns, i.e., a fraction of a full course. When only a fraction of a complete course is traversed by the rake mechanism, obviously, there is some overlap of the return course onto the course first laid. The desired width of this overlap is determined, not by the construction of the apparatus or any limitation on the process, but rather by the requirements of the use to which the ultimately formed fabric is to be put. Obviously, the less the amount of travel of the rake system, the greater will be the overlap of successive courses, and the denser will be the fabric formed; conversely, when the rake system travels a substantial percentage of the width of a course, there will be relatively little overlap of successive courses, and a lesser density of that layer in the finally formed fabric.

Because of the use of the rake system, particularly when used in conjunction with the slowing of the movement of the yarn carrying means near the extremities of travel, as set forth in my prior patent, complete parallelism within each layer is attained, with or without overlap. When there is overlap, the overlapped portions are parallel with the yarns of the first course, unlike the fabric construction set forth in my prior patent.

While my prior patent set forth the possibility of a movement of the yarn carrying means in a direction opposite that of the travel of the fabric forming mechanism, in addition to movement of the carrier back and forth between the conveyor, that is not required in accordance with the present invention to achieve parallelism of successive courses. It may be used as an additional means of achieving parallelism in accordance with the present invention, but is not required.

While the disclosure of the present invention primarily describes the use of a sewing machine to bind together the various layers of a bias laid, non-woven fabric, it will be appreciated that other methods of bonding the layers to each other can be employed, including knitting, adhesive application, etc.

In accordance with the present invention, the apparatus for stitching the various layers of the bias laid, non-woven fabric together can be any of the machines presently employed in the textile industry for such a purpose. For example, the machine presently sold by Liba Maschinenfabrik GmbH of West Germany, under the designation Copcentra-HS, is suitable for formation of fabrics in accordance with the present invention. Both because this machine is known to the trade, and because the present invention does not include, as novel subject matter, the method of stitching the various layers together, this specification will not include a detailed description of the sewing mechanism. The Liba Copcentra-HS machine is provided, in its operative gearing, with an oscillating crank mechanism. Because of the inherent nature of the operation of such a crank, the oscillating drive shaft controlled by the mechanism moves more slowly before its direction is reversed. By keying the movement of the yarn carrying means to this oscillating drive shaft, movement of the yarn carrying means is slowed at the end of each course, which allows the conveyor mechanisms to move relatively further forward than would otherwise be true, and aid in gaining parallelism of the various courses. The operation and construction of this portion of the Copcentra-HS machine is fully set forth in my prior patent, U.S. Pat. No. 4,556,440, and that portion of that patent is herein incorporated by reference.

In accordance with the present invention, a pair of parallel conveyors is formed, the front supports of the conveyors being at the head of a bonding mechanism, such as a Liba Copcentra-HS stitching machine. Each conveyor carries a series of equidistantly spaced needles which extend outwardly from the space between the conveyors. The fabric to be formed is placed on these conveyors and, more particularly, the individual yarns are placed around or on the individual needles. In general terms, each conveyor is comprised of an endless chain to which are attached members on which the individual needles are formed, the members, on the operating portion of the conveyor belt, forming a continuous, moving bar. The drive mechanism for the conveyors is independent of the drive mechanism for the yarn carriers, at least in the sense that the conveyors are moved at a constant speed.

Yarn carriers move back and forth between the moving conveyors. Each yarn carrier carries a plurality of individual, equally spaced yarns. The yarn carriers are caused to move beyond each conveyor and its associated rake system, as the yarn carrier passes beyond the rake system, it moves downwardly, so as to place the individual yarns which are carried around the needles on the rake system, or to cause the needle on the rake system to impale one of the yarns. Thus, it will be recognized that the number of yarns in a given linear dimension need not equal the number of needles in the same linear dimension. When number of yarns in a given linear dimension is greater than the number of needles in the same linear dimension, some of the yarns will be impaled by the needles, providing for a more uniform coverage. In this way, the density of each layer can be controlled, as desired.

The number of yarn carriers employed, and thus the number of individual layers, is determined by the end use of the bias laid, non-woven fabric being produced. The angle at which the yarn carriers place the courses of yarn on the moving conveyors is, likewise, determined by the end use to which the final fabric is to be put. While for many uses, angles of 45° to the long axis of the fabric, for each of two courses, is preferred, it will be apparent that other angular settings can be employed and that more than two layers can be placed on the moving conveyors. Generally, the bias laid layers are at angles of between 30° and 150° to the long axis of the fabric. In addition to the bias laid layers, however, a warp layer can be included in the fabric being formed, the yarns in the warp layer being placed in the standard manner essentially parallel to the moving conveyors. Similarly, one of the yarn carriers can be angled so as to place a weft layer onto the fabric being formed, the angle of the weft layer being the standard, essentially 90°, to the long axis of the fabric.

As previously indicated, the two conveyors move at a constant speed toward the bonding mechanism where the fabric layers are bound together. The yarn carrying means, while moving at a generally constant speed across the fabric being laid, can be slowed down in their travel across the fabric at the end of each course. Because the movement of the yarn carrier can be keyed to an oscillating crank mechanism, and because that crank mechanism slows down near the end of each stroke, movement of the yarn carrying mechanism is also slowed near the end of the stroke, which is keyed to correspond with the end of the course.

Thus, the present invention provides for the formation of bias laid fabrics where all of the yarns in a given layer are parallel to each other. The parallelism in a given layer is achieved without complex machinery. Further, because the number of yarns need not equal the number of needles over a given linear dimension, greater density and uniformity are provided. Use can be made of the mechanism of the bonding portion of the apparatus to aid in the laying of the yarns so as to achieve these advantages.

BRIEF DESCRIPTION OF THE DRAWINGS

In the accompanying drawings:

FIG. 1 is a plan view of one preferred form of bias fabric in accordance with the present invention;

FIG. 2 is a plan view of a second form of bias fabric in accordance with the present invention;

FIG. 3 is a perspective view, partly representational, showing the mechanism for placing the bias laid yarns on the conveyors;

FIG. 4 is a top plan view showing the conveyor, conveyor needles, rake system, and yarn carrier in accordance with the present invention along the line 4—4 of FIG. 3;

FIG. 5 is a sectional view showing a single needle of the conveyor system and a single needle of the rake system, with the yarn carrier beyond, and below, the rake system; and FIG. 6 is a sectional view along the line 6—6 of FIG. 4.

DETAILED DESCRIPTION OF THE INVENTION

Referring to the drawings, FIG. 1 illustrates a layer of yarns laid with the process and apparatus of the present invention, including a first course C and a second course C'. As will be apparent, each of the courses is laid at an angle of approximately 45° to the direction of the fabric forming mechanism shown by the arrow A. The apparatus and process of the present invention are so adjusted in forming the fabric of FIG. 1, that course C' is laid adjacent course C, without any overlap; however, as will be apparent, the two courses are parallel to each other.

In FIG. 2, a fabric is formed in accordance with a second embodiment of the present invention where the process and apparatus are adjusted to provide for an overlap of yarns in successive courses. Thus, with a fabric forming direction illustrated with the arrow B, a first yarn course D is laid at approximately a 45° angle to the fabric forming mechanism. A second course D' is then laid parallel to course D, and overlying approximately one-half of the width of course D. It will be appreciated that FIG. 2 is merely one illustration of the amount of overlap which can be achieved employing the process and apparatus of the present invention, more or less overlap being possible and being dictated by the requirements of the finished fabric.

An overview of the placement of the bias laid yarns in accordance with the present invention is shown in FIG. 3. The system is similar to that described in my U.S. Pat. No. 4,556,440. Two endless conveyors 30 and 31 are shown, respectively, on the left and right hand sides. These conveyors 30 and 31, which are of the same length, are driven at the same speed by forward pulleys 32 and 33 and are suspended on rearward pulleys 34 and 35. Forward pulleys 32 and 33 are connected by axial member 36, while rearward pulleys 34 and 35 are connected by axial member 37. Each conveyor includes a plurality of blocks 40. Formed onto, or from, each block are a series of sharp needles 42 best illustrated in FIG. 4.

Formed across, but slightly above, the conveyors 30 and 31 are a plurality of guide arms 50, 51, 52. Three such arms are illustrated for laying of three layers of yarn, but it will be appreciated that additional guide arms and complete yarn laying assemblies can be provided, depending upon the number of layers of yarn to be incorporated into the bias laid fabric. Similarly, the number of such guide arms can be reduced to two. Moving along each of the guide arms is a member 53 to which is attached a yarn carrier 54, each yarn carrier being employed for laying a plurality of yarns 55. It will be appreciated, from a review of FIG. 3, that regardless of the angling of the guide arms 50, 51, 52, the yarn carrier 54 is placed in a direction parallel to the movement of the conveyors 30, 31.

As illustrated in my prior patent, U.S. Pat. No. 4,556,440, the yarn carriers are mounted in a slot so that they dip down below the level of the needles 42, and similar needles formed on the rake systems, to be described, in order to allow the yarns 55 being carried to be caught in the rake system at either end of the travel of the carriers 54. As also set forth in that patent, each of the carriers 54 may be mounted on a pneumatic cylinder attached to a source of air or other gas under pressure to allow movement of the carrier 54 rearwardly as the yarns are caught on the rake system.

While not illustrated, a device having means to hold the individual yarns in the fabric 60 together is placed at the end of the mechanism illustrated in FIG. 3, just before the pulleys 32, 33. This device can be a stitching machine; such as the previously described Liba Copcentr-HS, can be a different type of stitching machine, a knitting machine, or a device which applies an adhesive at selected points along the fabric length and width in order to hold the yarns together, prior to impregnation.

Through a driving means the yarn carriers are moved back and forth across the short axis of the fabric being formed. Either the bonding mechanism contains a driving means, such as an oscillating crank mechanism, which causes the speed of the yarn carrier to be reduced near the end of its travel, or such an oscillating crank mechanism can be provided, separate and apart from the bonding unit, in order to accomplish the same results. While the slowing down of the carriers 54 near the end of travel, beyond the conveyors, can be omitted when the rake system is employed, this slowing down is an aid to attaining parallelism of the yarns, even with the rake system.

In addition to being slowed down by this mechanism at either end of its travel, it is necessary to cause the yarn carrier to drop down below the level of the needles 42, when the carrier has passed beyond those needles and the associated conveyor. This dropping down is required in order to allow the yarns to be wrapped around the needles, or to be impaled by them. This is accomplished by mounting the yarn carrier on a guide pin which travels in a horizontal slot in a guide arm, that slot being angled downwardly beyond the conveyor and the rake system, so as to cam the yarn carrier downwardly, and move the yarns below the horizontal level of the needles. On the return stroke, the yarn carrier moves upwardly, completing the operation of wrapping the yarns around the needles, or impaling them; and then returns across the fabric being formed.

The particular improvement of the present invention involves the rake systems illustrated, on the left hand side of the machine, as numbers 70, 71, and 72 and, on the right side of the machine, as 80, 81, and 82. While the general structure of each of these rake mechanisms, and their method of operation, is the same, there are some variations, as will be detailed below. The rake systems and their operation are best illustrated in FIGS. 4, 5, and 6.

As illustrated in FIGS. 3 and 4, the conveyors 30 and 31 have a number of blocks 40 formed on an endless chain. Extending from each of the blocks 40 are sharp needles 42 which are spaced equidistantly. As best seen in FIG. 4, the needles extend at, essentially, right angles to the blocks 40 and conveyor 31. As best illustrated in FIG. 5, the needles 42 are angled slightly upwardly from the blocks 40. This slight angling upwardly is provided to allow grabbing of the threads and proper interaction of the needles 42 with the rake systems 70, 71, 72, 80, 81, and 82, and the carriers 54. The amount of angling should be from 10° to 40°, preferably from 20° to 30°.

The rake system illustrated in FIG. 4 is, essentially, the one shown in FIG. 3 as 80. While the guide member 50 is, essentially, at a 45° angle to the conveyor 31, the carrier 54 is, essentially, parallel to that conveyor. The needles 100 formed on rake 80 are at approximately a 45° (135°) angle so as to supplement the angle of the guide member 50 and provide the proper interaction with the yarns being carried by the carrier 54. The angling of the needles 100 on the rake system should correspond, roughly, to the supplement of the angle of the particular guide member in association with which they are used. Thus, if the guide member is at 30°, the needles on the rake system should be at 150°; if the guide member is at 45°, the needles on the rake system should be at 135°; if the guide member is at 60°, the needles on the rake system should be at 120°; if the guide member is at 90° to the direction of travel of the fabric being formed, the needles 100 on the rake system should be at 90°. It has been found, however, that the 45° rake system can be employed with both the 30° and 60° guide members.

As best illustrated in FIG. 5, the needles 100 on the rake system have an essentially vertical portion 101, extending upwardly from the rake system 80, and are then bent over at 102, so that the point of the needle 103, is angled downwardly. Generally, the angle E between the upstanding vertical portion 101 and the portion of needle 100 on which the point 103 is formed is the same as the angle F between the needle 42 and the block 40. The angle E may be greater than the angle F, but the point 103 must lie below the needle 42. Preferably, the angle E is approximately 55°. This is to prevent the yarn from escaping from the rake as the carrier is raised, and then travels back across the conveyor system. The alignment, bending, and angling of the needles 100 from the rake system 80 is best illustrated in FIG. 6. It will be appreciated, as just described, that the angling of the needles 100 on the rake system 82 will be exactly opposite that shown in FIGS. 4 and 6, and the angling of the needles 100 on the rake systems 71 and 81 will be at essentially right angles to the rake systems 71 and 81 and, therefore, at, essentially, right angles to the conveyors 30 and 31. The angling of the needles on the rake system 70 will be essentially the same as those on the rake system 82, while the angling of the needles on the rake system 72 will be essentially the same as those on the rake system 80.

In operation, and referring, particularly, to the rake system 80 of FIG. 4, as the conveyor 31 moves in the direction indicated by the arrow G, and the carrier 54 moves in the direction indicated by the arrow H, the yarns 55 are moved to a point beyond the rake system 80 and below the points 103 of the needles, as best illustrated in FIG. 5. The rake system 80 then moves in the direction indicated by the arrow I in FIG. 4 so as to firmly grasp the yarns 55 which are in the vicinity of the needles 100 formed on the rake system 80. As previously indicated, the individual yarns 55 may either fall between adjacent needles 100, or may be impaled on an individual needle 100. Obviously, with certain types of yarns, such as carbon fibers, the sizing and spacing of the yarns 55 and the carrier 54 would be such that none of these yarns would be impaled.

As the carrier 54 is raised upwardly, away from the rake system 80, it begins to move in a direction opposite the arrow H and, because of the tension in the yarns, pulls the yarns off of the rake needles and places them, firmly, on the needles 42 formed on the conveyor 31, as illustrated by the yarn 55' in FIG. 4.

When the conveyor 54 has completed its travel across the fabric being formed, to the opposite conveyor 30, the process is repeated, with one exception. In returning across the fabric being formed to the conveyor 30, the yarns are beyond, and below, rake system 70, when the conveyor 54 dips down. In order to assure retention of the yarns 55 in the needles 100 of the rake system 70, the rake system 70 must first move slightly forward, i.e., in the same direction as the conveyor 30 is travelling, before it is moved rearwardly for depositing of the yarns 55 on and within the needles 42 of the conveyor 30. Only a slight movement of the rake 70 in a forward direction, i.e., a distance sufficient to place the yarn over the needles 42 formed on the conveyors 30 and 31. Generally, the forward movement of the rake system 70 is approximately the distance between two of the needles 100, preferably the distance between two to three of the needles 100. The amount of movement required tends to vary with the thickness of the yarn.

The operation of the rake systems 71 and 81, and of the rake system 72 is the same as that described for the rake system 80. This is because the carrier 54 is moving either at right angles, or in a direction opposite the direction of travel of the fabric being formed. The operation of the rake system 82 is the same as that of the rake system 70, since the carrier 54, at that point, is moving in the same direction as the direction of travel of the fabric being formed.

While the means for moving the various rake systems are not illustrated, any convenient means can be employed. Thus, the rakes may be moved pneumatically, mechanically, or by a solenoid movement.

As previously indicated, the density of the fabric can be controlled by overlapping of return courses on first courses. This is accomplished without loss of parallelism. Further, this increased density is accomplished without requiring too high a concentration of yarns in each carrier, a situation which could lead to difficulty in operation of the mechanism. Without the rake systems of the present invention, this overlapping with paralellism could not be accomplished. The amount of overlap accomplished is, generally, based upon the width of the yarns 55 in the carrier. Obviously, this width has nothing to do with the denier of the yarns, but rather refers to the dimension W shown in FIG. 3. As this width increases, with the same travel of the rake system, there is a greater overlap of yarns, while as the width W is decreased, with the same movement of the rake system, there is less of an overlap of yarns.

The amount of movement of the rake systems 70, 71, 72, 80, 81, and 82, and of the carriers 54, in a direction opposite the direction of fabric formation is dependent upon the speed of the conveyor. The speed of the conveyor is dependent upon the number of stitches per inch being placed by the needling machine, when one is used, i.e., the fewer the number of stitches, the faster can be the fabric formation.

As indicated in my prior patent, the number of yarns in the carrier 54 need not correspond to the spacing of the needles 42 formed on the conveyors. Similarly, the number of yarns in the carrier 54 need not correspond to the number of needles 100 on the rake system in the same linear dimension, nor do the number of needles 100 in the rake system have to correspond with the number of needles 42 on the conveyor in the same linear dimension. As previously indicated, the ability to impale some yarns aids in control of density uniformity.

As indicated, the fabric formed in accordance with the present process is generally used in the formation of structural parts, as in airplanes, and in such a use is wrapped around a mold, or laid into a particular position, after which, or prior to, being impregnated with a resin. When the fabric is fully in place and impregnated, the resin is cured to complete formation of the part.

While the description of the present invention has involved a stitching of the various fabric layers together, it will be appreciated that other methods for holding the non-woven fabric in place can be employed. For example, a loose knitting operation, as is known in the art can be employed. Further, a light resin spray can be applied to bond the fibers at their crossing points.

Again, the material which is employed for this bonding, or the materials used, are not of critical importance, as the ultimate strength of the bias laid non-woven fabric comes from the resin which is finally used for impregnation and which is cured with the fabric in place. If the bonding mechanism used for the fabric does not have a device, such as the oscillating crank of the Liba Copcentra-HS, then such a mechanism can be independently provided for driving of the yarn carriers in order to provide for their reduced speed of motion near the ends of the travel paths.

No mention has yet been made in this specification of the loops which are obviously formed, either by the yarns wrapping around the various needles or by being impaled on them. As is apparent, these loops are at the extremities of the width of the fabric being formed. After stitching or other methods of bonding, so that the fabric is generally held together, the loops can be cut away by any known mechanism. Once the other bonding means have been put into place, the loops, which had served only the function of holding the fabric in place up until that time, are no longer required.

While the invention has been illustrated and described in accordance with the particular embodiments, it will be apparent to those skilled in the art that variations are possible within the spirit and scope of the invention. Accordingly, the invention is not to be considered as limited except as set forth in the appended claims.

I claim:

1. An apparatus for forming a bias-laid non-woven fabric including:

a. a pair of parallel conveyors, said conveyors being parallel to the long axis of a bias-laid, non-woven fabric to be formed, and lying at the extremities of the short axis of said fabric, said conveyors being provided with a first plurality of equally spaced needles, said first plurality of needles facing away from said fabric to be formed;

b. at least two yarn carriers, each said carrier having a plurality of openings, each said opening being provided so as to accommodate a single yarn to be laid in the traversing of said yarn carrier from one conveyor to the other conveyor, the mounting for said yarn carrier providing for travel of said yarn carrier to a point beyond the needles formed on said conveyors;

c. first means to drive said conveyor mechanisms;

d. second means to drive said yarn carriers;

e. a pair of rake means for each said yarn carrier, a first rake means being placed beyond said one conveyor within the limit of travel of said yarn carrier and a second rake means placed beyond said other conveyor in association with the end of travel of said yarn carrier, each said rake means being provided with a second plurality of equally spaced needles, said second plurality of needles facing towards said fabric to be formed;

f. means to move said rake system in a first direction parallel with the direction of said associated conveyor and then in a second direction opposite to the direction of movement of said conveyor, when the direction of the yarns carried by said associated yarn carrier is essentially the same as the direction of movement of said conveyor, and means to move said rake means in a direction opposite the direction of movement of said conveyor for all other yarn carriers; and g. means for bonding the formed, bias-laid, non-woven fabric.

2. The apparatus of claim 1 wherein the number of openings per linear dimension in said yarn carrier is greater than the number of first needles per linear dimension on each conveyor.

3. The apparatus of claim 2 wherein said second plurality of needles is angled in a direction essentially supplementary to the angle of the yarns in said associated yarn carrier.

4. The apparatus of claim 1 wherein each of said second plurality of needles is formed with a hook.

5. The apparatus of claim 1 wherein said second drive means includes means for reducing the speed of movement of said yarn carriers at the extremities of travel.

6. The apparatus of claim 1 wherein the mounting for said yarn carriers includes means to vertically depress said carriers at a point outside of each said conveyor.

7. An apparatus for forming a bias-laid non-woven fabric including:

a. a pair of parallel conveyors, said conveyors being parallel to the long axis of a bias-laid, non-woven fabric to be formed, and lying at the extremities of the short axis of said fabric, said conveyors being provided with a first plurality of equally spaced needles, said first plurality of needles facing away from said fabric to be formed;

b. at least one yarn carrier, each said carrier having a plurality of openings, each said opening being provided so as to accommodate a single yarn to be laid in the traversing of said yarn carrier from one conveyor to the other conveyor, the mounting for said yarn carrier providing for travel of said yarn carrier to a point beyond the needles formed on said conveyors, and also providing for vertical depression of said yarn carrier at a point outside of each said conveyor;

c. first means to drive said conveyor mechanisms;

d. second means to drive said yarn carrier, said second means providing for reduction in the speed of movement of said yarn carrier at the extremities of travel;

e. a pair of rake means for each said yarn carrier, a first rake means being placed beyond said one conveyor within the limit of travel of said yarn carrier and a second rake means placed beyond said other conveyor in associated with the end of travel of said yarn carrier, each said rake means being provided with a second plurality of equally spaced needles, said second plurality of needles facing towards said fabric to be formed;

f. means to move said rake system in a first direction parallel with the direction of said associated conveyor and then in a second direction opposite to the direction of movement of said conveyor, when the direction of the yarn carried by said associated yarn carrier is essentially the same as the direction of movement of said conveyor, and means to move said rake means in a direction opposite the direction of movement of said conveyor for all other yarn carriers; and g. means for bonding the formed, bias-laid, non-woven fabric.

8. The apparatus of claim 7 wherein the number of openings per linear dimension in said yarn carrier is greater than the number of first needles per linear dimension on each conveyor.

9. The apparatus of claim 7 wherein said second plurality of needles is angled in a direction essentially supplementary to the angle of the yarns in said associated yarn carrier.

10. The apparatus of claim 7 wherein each of said second plurality of needles is formed with a hook.

11. The apparatus of claim 7 comprising a single yarn carrier.

* * * * *